US006497400B2

(12) United States Patent
Bühlmayer et al.

(10) Patent No.: US 6,497,400 B2
(45) Date of Patent: Dec. 24, 2002

(54) CABLE CONTROL WITH A SIMPLIFIED ASSEMBLY

(75) Inventors: Reiner Bühlmayer, Pfedelbach (DE); Helmut Noller, Uttenhofen (DE); Richard Müller, Gaisbach (DE); Anita Schmiedt, Neuenstein (DE); Manfred Finzel, Kunzelsau (DE)

(73) Assignee: R. Stahl Fordertechnik GmbH (DE)

( * ) Notice: Subject to any disclaimer, the term of this patent is extended or adjusted under 35 U.S.C. 154(b) by 0 days.

(21) Appl. No.: 09/242,505

(22) PCT Filed: Aug. 8, 1997

(86) PCT No.: PCT/DE97/01689

§ 371 (c)(1),
(2), (4) Date: Feb. 16, 1999

(87) PCT Pub. No.: WO98/07646

PCT Pub. Date: Feb. 26, 1998

(65) Prior Publication Data

US 2001/0013593 A1 Aug. 16, 2001

(30) Foreign Application Priority Data

Aug. 22, 1996 (DE) ..... 196 33 832

(51) Int. Cl.[7] ..... B66D 1/14
(52) U.S. Cl. ..... 254/342
(58) Field of Search ..... 254/342, 344; 242/903, 613.5

(56) References Cited

U.S. PATENT DOCUMENTS

| | | | | |
|---|---|---|---|---|
| 3,190,617 A | * | 6/1965 | Burrows | 254/342 |
| 4,019,718 A | | 4/1977 | Freiburger | 254/187.5 |
| 4,123,040 A | * | 10/1978 | Kuzarov | 254/342 |
| 4,426,064 A | * | 1/1984 | Healy | 254/342 |
| 4,860,965 A | * | 8/1989 | Hodgetts | 254/342 |
| 5,167,400 A | * | 12/1992 | Gazel-Anthoine | 254/342 |

FOREIGN PATENT DOCUMENTS

| | | |
|---|---|---|
| DE | 438528 | 12/1926 |
| DE | 1171135 | 5/1964 |
| DE | 1205247 | 11/1965 |
| DE | 2448357 | 4/1976 |
| FR | 1349702 | 4/1964 |
| FR | 1478867 | 7/1967 |

* cited by examiner

*Primary Examiner*—Emmanuel Marcelo
(74) *Attorney, Agent, or Firm*—Leydig, Voit & Mayer, Ltd.

(57) ABSTRACT

In a rope hoist (9), the output shaft (37) of the gearing (19) is provided in one piece with an end plate (57). This end plate (57) is designed in such a way that it can be inserted into a locating seat (66) of the tubular rope drum (17). The end plate (57) is screwed in the rope drum (17) by means of radial fitting screws (72). There is also a recess (67) at the other end of the rope drum (17), and a similar end plate (75) can be fastened in this recess (67) in the same manner. This other end plate carries a bearing journal (76). On account of this arrangement, the manufacture of the rope drum (17) and the entire assembly are simplified, complicated shaft joints between the output shaft (37) and the rope drum (17) being dispensed with on account of the mounting of the rope drum (17) by means of the output shaft (37) of the gearing (19). In addition, the rope hoist (9) may be split up into comparatively small subassemblies for dispatch.

14 Claims, 4 Drawing Sheets

CABLE CONTROL WITH A SIMPLIFIED ASSEMBLY

Figure 1:
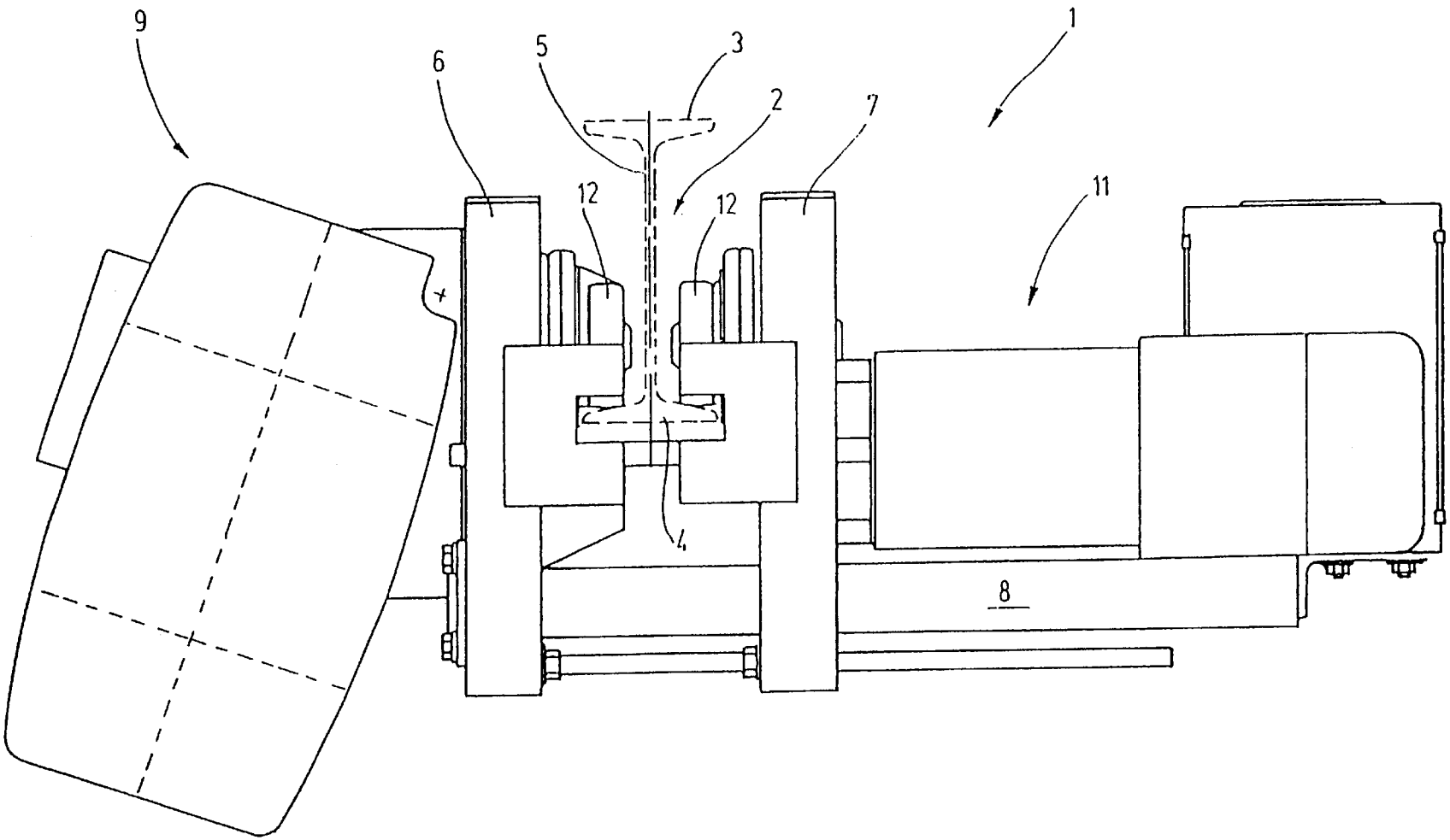

In rope hoists, the rope drum is driven by an electric motor via interposed reduction gearing. The difficulty in this case consists in mounting the rope drum in such a way that alignment errors between the various bearings for the rope drum and the gearing are avoided as far as possible in order to avoid distortions and resulting increased wear of the bearings. This is not without its problems, because the rope drum has a considerable length and a considerable mass, so that the alignment of the bearings present at the ends cannot be easily produced with the required precision.

A further criterion is the number of components which are necessary for the drive and the mounting. Here, considerable attention has to be paid to the type of mounting of the rope drum, which for reasons of weight is tubular.

DE 12 05 247 B discloses a rope hoist whose rope drum contains a welded-in conical flange disk at one end, a tubular bearing journal being welded in place in the inner bore of the flange disk. The bearing journal in turn forms the output shaft of gearing, and the output gear of the reduction gearing sits on this output shaft in a rotationally locked manner. Located between the output gear and the rope drum is a rolling-contact bearing, which is accommodated in a bearing seat arranged in the frame of the rope hoist.

Since, in this design, the bearing journal, which is at the same time the output shaft of the gearing, cannot be separated from the rope drum, assembly of the rope hoist is extremely complicated. In addition, manufacture of the rope drum is expensive, for the flange disk welded to the bearing journal must first of all be welded into the rope drum. Only after that may the bearing journal be machined in order to produce the bearing seats. Producing the bearing seats before the welding in place would on no account result in the required precision. Slanting of the bearing seats of the bearing journal at least relative to the axis of the rope drum would be unavoidable, a factor which would cause enormous distortions in the gearing.

DE 438 528 C shows a rope hoist in which the rope drum is provided with an integrally cast hub, which is supported on the drum wall via spokes. Coaxially to this hub, the rope drum is provided with a recess, into which a cup-shaped internal gear is inserted. On the side of the drum hub, the internal gear merges into a disk-shaped base, from which a tubular extension protrudes. The hub and tubular extension are connected to one another via seats, so that the mounting of the drum is effected via the tubular extension of the internal-gear arrangement and the hub.

In this arrangement, the gearing output shaft, which carries a pinion meshing with the internal gear, is therefore separate from the drum mounting.

Since the internal gear is fastened by means of screws which are screwed into the end face of the rope drum, the rope drum must be relatively thick-walled, a factor which needlessly increases the weight of the rope drum. In addition, assembly and manufacture of the rope drum in this known solution is expensive.

DE 24 48 457 A1 shows a rope hoist in which multistage gearing is arranged in the interior of the rope drum. A bearing race forms the closure of the gearing at the end face of the rope drum, this bearing race being inserted into the rope drum and being rotationally locked by means of dowel pins, which pass radially through the drum. The race is mounted on an extension of the gearbox by means of a ball bearing. Alignment errors of this bearing seat, relative to the gearing in the interior of the rope drum, either load the bearing seat or lead to incorrect positions of the gears in the interior of the rope drum and thus to increased wear.

Against this background, the object of the invention is to provide a rope hoist in which a lightweight rope drum can easily be produced and in which no separate bearing points are necessary for the output shaft and the drum mounting.

In the novel solution, use is made of the fact that the rope drum must in any case be machined by turning. In this connection, locating seats which are coaxial to the outside of the rope drum can be produced on both front ends. These locating seats serve to locate end plates, which carry bearing journals. This ensures that the axes of the bearing journals are largely aligned both with one another and with the axis of the rope drum. One of the bearing journals is at the same time designed in such a way that it constitutes the output shaft of the reduction gearing. In this way, the mounting of the output shaft of the gearing at the same time becomes the mounting of the rope drum, a factor which makes additional bearings on the gearing side and compensating devices in the drive shaft unnecessary.

Since the end plate is inserted merely into the locating seat, greatly simplified assembly results. The gearing, with the output shaft and the gears, can be ready assembled and constitutes a comparatively light unit assembled at the works. In this case, no heavy or unwieldy rope drum impairs the assembly of the gearing, which can readily be checked without rope drum for operability and proper bearing play.

For the further assembly, it suffices to insert this preassembled gearing unit with the end plate sitting thereon for the rope drum into the latter and to secure it in the rope drum by means of the radially running fastening screws. Securing the end plate in the drum in this way permits the use of a rope drum whose wall thickness is dimensioned solely from the point of view of loading by the rope and is not needlessly enlarged on account of the use of screws screwed into the end face. Furthermore, the rope drum in the novel rope hoist is a simple tubular structure, on which no sensitive bearing journals project, as is partly the case in the prior art.

In addition, the radially running fastening screws for the end plate have the advantage of easy accessibility and they require no additional construction space between the rope drum and the adjacent gearbox wall.

The locating seat is preferably a recess, consisting of a cylindrical surface and an annular shoulder. If this annular shoulder is located in the interior of the rope drum, it is optimally protected against damage during transport. The annular shoulder, together with the cylindrical surface, forms a very good means of exactly centering the end plate in order to avoid wobbling runout and radial runout of the output shaft relative to the drum axis and the other bearing journal.

Assembly is further simplified if the output gear is profile-interlocked with the output shaft. As a result, simple slip-on attachment, which requires no especially large assembly force, is possible.

An especially robust construction is obtained if the gearbox is an essentially one-piece hollow formed part, in which the two end walls and the side-wall arrangement are connected to one another in one piece, the requisite bearing seats being accommodated in the end walls. For the purpose of assembly, an opening is contained in the side-wall arrangement in the region of the bearing seats for the output shaft, and the output gear sitting on the output shaft can be inserted through this opening.

In the novel rope hoist, the drive motor preferably sits outside the rope drum. Standard motors may therefore be used, and the cooling of the motor is not impaired by the surrounding rope drum and the air gap between motor and rope drum.

Figure 2:
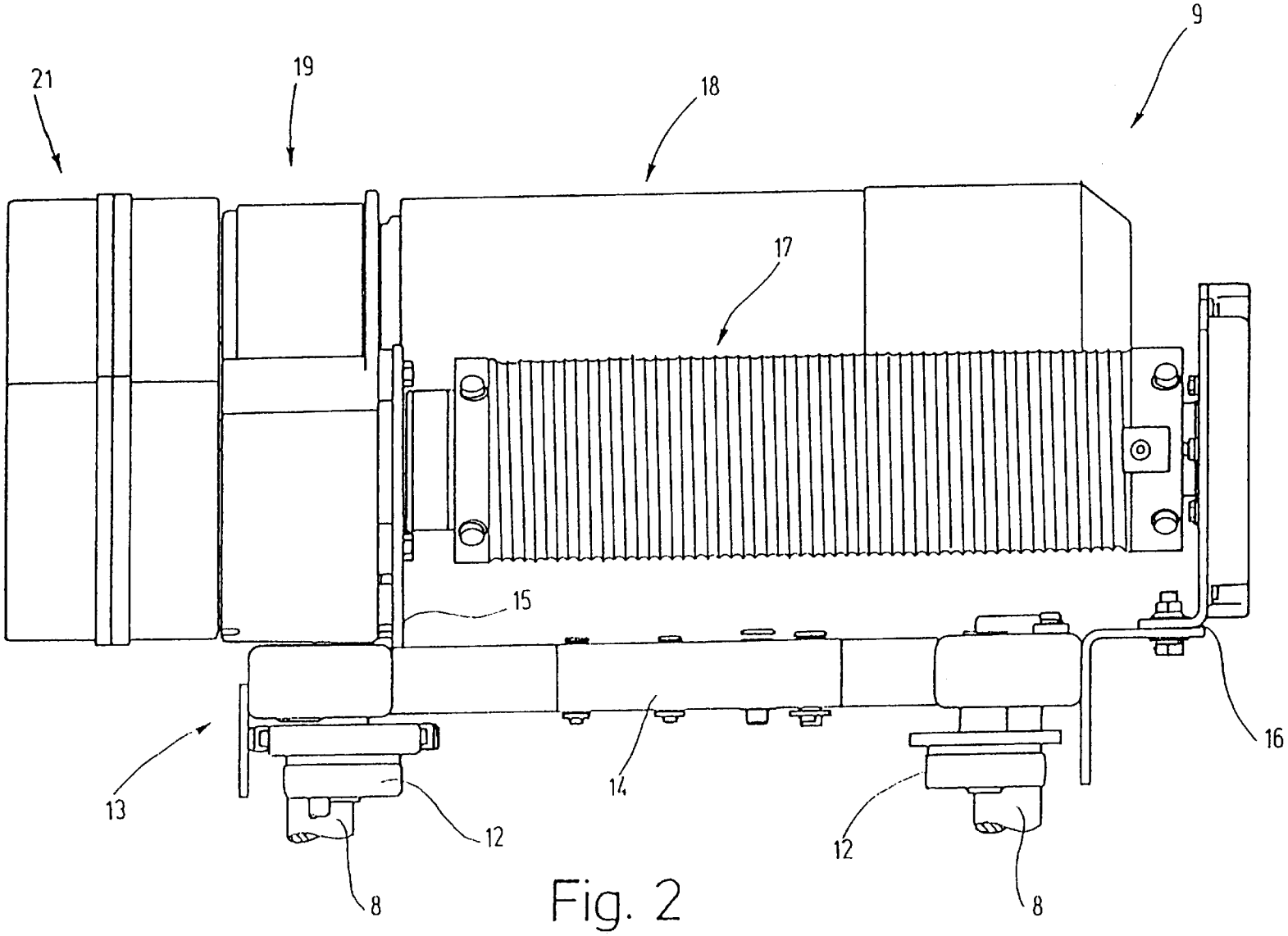
Figure 3:
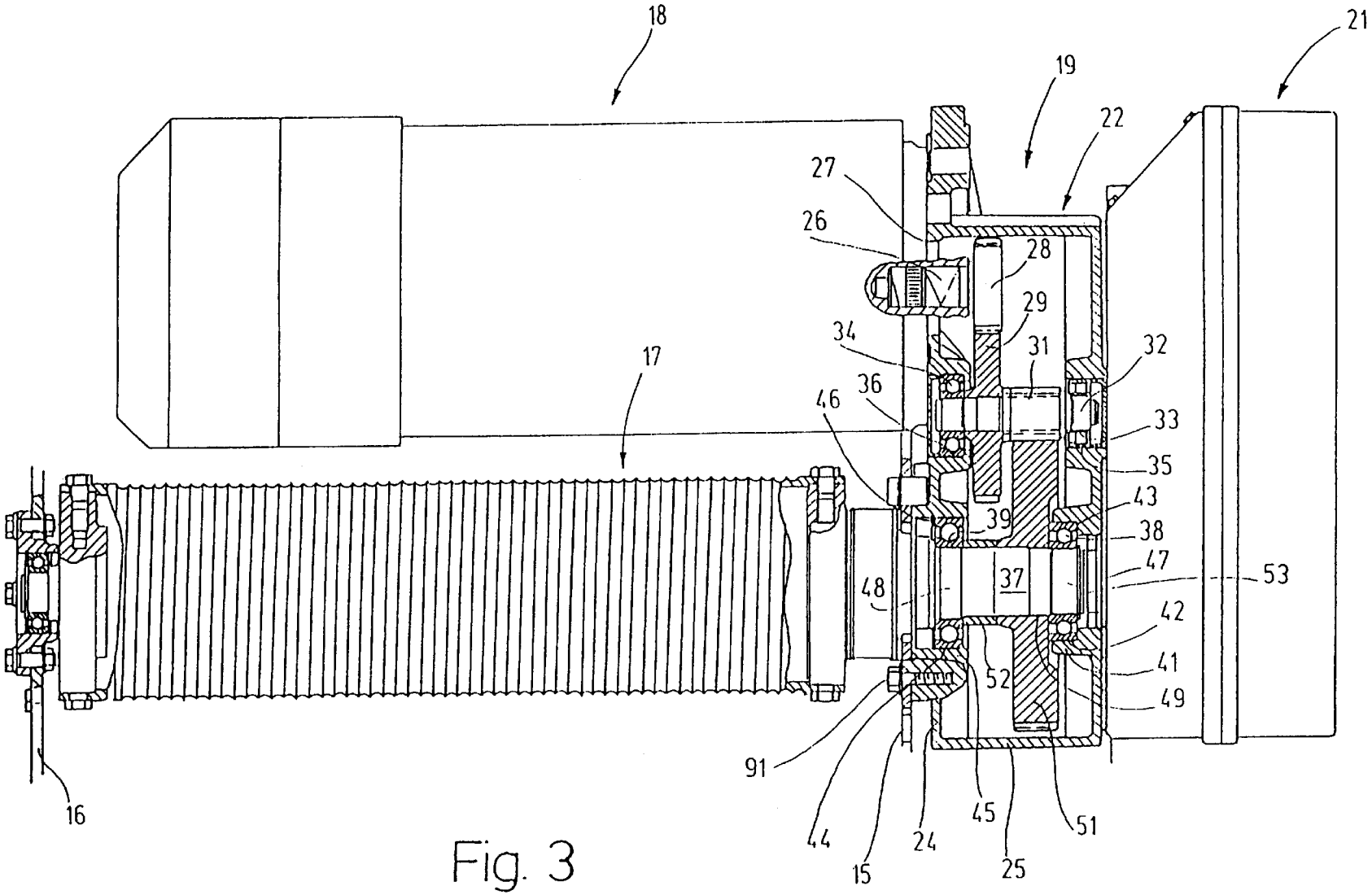
Figure 4:
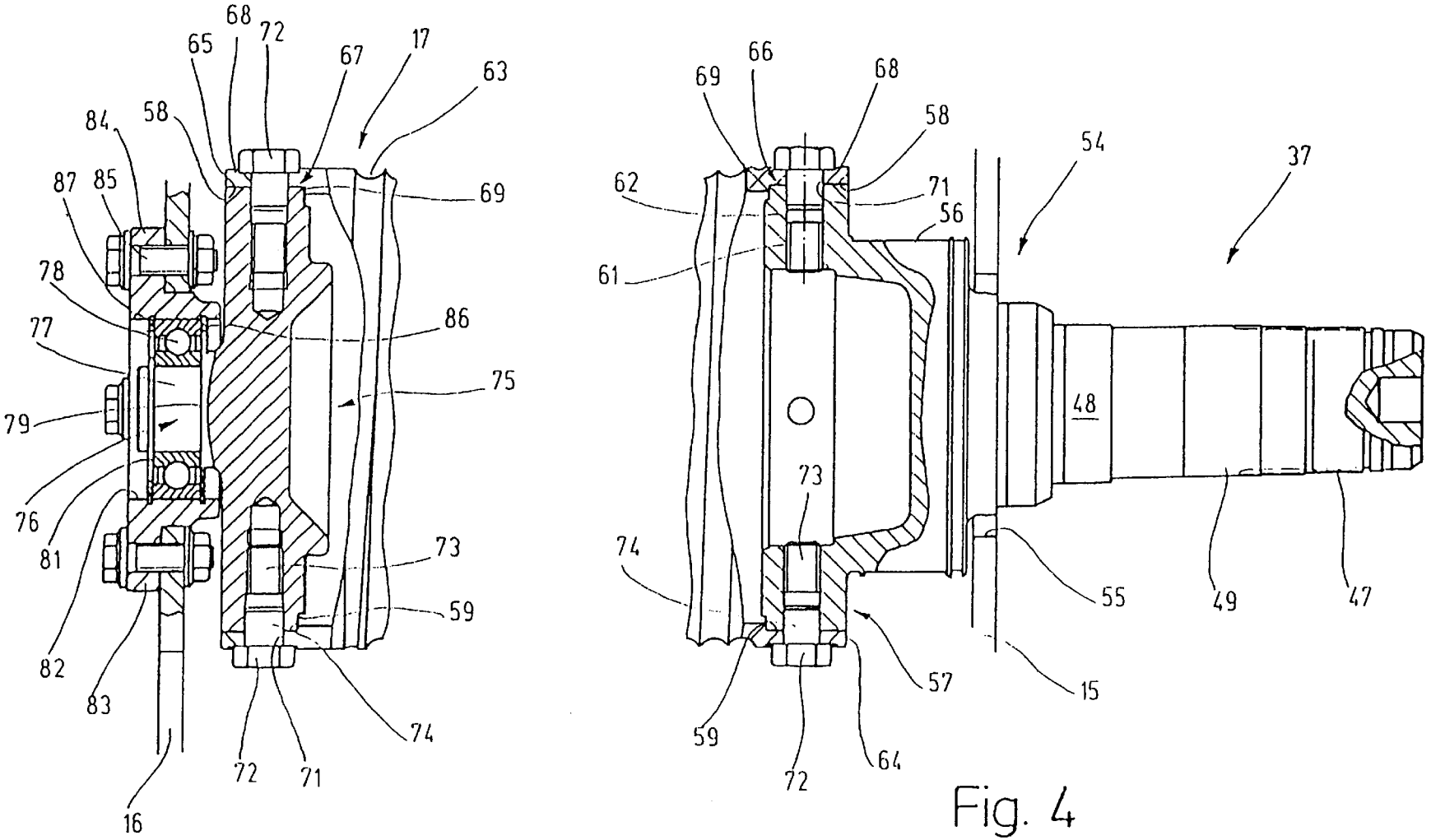

An exemplary embodiment of the subject matter of the invention is shown in the drawing, in which:

FIG. 1 shows an end view of a crab, in which the novel rope hoist is attached to one side, FIG. 2 shows a plan view of that side of the crab to which the novel rope hoist is fastened, FIG. 3 shows the novel rope hoist in a side view with sectioned gearbox and sectioned mounting of that end of the rope drum which is remote from the gearbox, FIG. 4 shows the connection of the end plates to the rope drum as well as the mounting remote from the gearing, in an enlarged representation and in a section similar to that of FIG. 3.

Illustrated in FIG. 1 is a crab 1, which is intended to run along a travel rail 2. The travel rail 2 consists of an I-girder having a top flange 3, a bottom flange 4 and a straight web 5 connecting the two flanges. The crab carriage 1 runs on the top side of the bottom flange 4.

Belonging to the main components of the crab 1 are two carriage cheeks 6 and 7, which are arranged in parallel at a distance from one another and between which the travel rail 2 runs and which are connected to one another via two connecting columns 8 parallel to one another.

The carriage cheek 6 comprises a rope hoist 9, whereas the other carriage cheek 7 is provided with a travel-drive motor 11 and a counterweight 2.

Rotatably mounted on the sides facing one another of the two carriage cheeks 6 and 7 are a total of four running wheels 12, of which the two running wheels 12 facing the viewer are set in rotation together via the travel-drive motor 11.

The carriage cheek 6 is formed by a frame 13 of the rope hoist 9, and belonging to said carriage cheek 6 is an elongated frame-base means 14, which extends in a direction parallel to the travel rail 2 and on which the two running wheels 12 are rotatably mounted, as well as two frame-head means 15 and 16 fastened to the frame-base means 14. The frame-head means 15 and 16 are robust flange plates, which are screwed to the frame-base means 14 and run in parallel to and at a distance from one another. Rotatably mounted between the two frame-head means 15 and 16 is a rope drum 17, which is driven by a drive motor 18 via gearing 19. As FIG. 2 also shows, the gearing 19 is screwed to the frame-head means 15; specifically, it is located on the side remote from the frame-head means 16.

For the sake of completeness, it may also be mentioned at this point that a terminal and control box 21 is arranged on the gearing 19.

As FIG. 3 shows, the gearing 19 comprises a gearbox 22, which is formed by two gearbox end walls 23 and 24, arranged parallel to one another and at a distance from one another, and a side-wall arrangement 25 extending between the two gearbox end walls 23 and 24 and closed in all round. The side-wall arrangement 25 is in one piece with the two gearbox end walls 23 and 24. This results in an especially torsionally rigid construction, which is able to directly mount the motor 18.

The motor 18 is screwed by fastening means (not shown) to the gearbox end wall 24 appropriately reinforced in this region, its armature shaft 26 projecting through a hole 27 in the gearbox end wall 24 into the interior of the gearbox 22. A drive pinion 28 sits in a rotationally locked manner on that end of the armature shaft 26 which projects into the gearbox 22. This drive pinion 28 meshes with a gear 29, which is arranged in a rotationally locked manner together with a further pinion 31 on a layshaft 32.

The layshaft 32 is rotatably mounted by means of two rolling-contact bearings 33 and 34. The rolling-contact bearing 33 is located in a bearing seating bore 35 in the gearbox end wall 23, whereas the ball bearing 34 is arranged in a bearing seating bore 36 which is located in a protuberance of the gearbox end wall 24. The two bearing seats 35 and 36 are in alignment with one another.

Axially parallel to the layshaft 32, the gearing 19 contains an output shaft 37, which is likewise rotatably mounted in the gearbox 22 by means of two ball bearings 38 and 39. There is a protuberance 41, projecting inward, in the gearbox end wall 24 where the ball bearing 38 is located, and this protuberance 41 is provided with a bearing seating bore 42 into which the ball bearing 38 is pressed. The bearing seating bore 42 ends at an annular shoulder 43.

In alignment with the bearing seating bore 42 is a bearing seating bore 44, which is made in a protuberance 45, pointing inward, of the gearbox end wall 24. The bearing seating bore 44 has a larger diameter than the bearing seating bore 42, so that, although the gearbox 22 is in one piece, the ball bearing 38 can be pressed through the bearing seating bore 44 into the bearing seating bore 42. A retaining ring 46 arranged further on the outside secures the ball bearing 39 toward the outside in the bearing seating bore 44.

Formed on the output shaft 37 are two bearing seats 47 and 48, which are adapted to the ball bearings 38 and 39 and are also at a distance from one another corresponding to the distance between the two ball bearings 38 and 39.

Both bearing seats 47 and 48 are cylindrical surfaces, the diameter of the bearing seat 47 being smaller than the diameter of the bearing seat 48. Formed at 49 between the two bearing seats 47 and 48 is a profile interlocking system, for example a multi-spline interlocking system, which serves to locate a hub bore of an output gear 51 in a rotationally locked manner. The output gear 51 meshes with the pinion 31 and bears with the right-hand end face against the inner bearing race of the deep-groove ball bearing 38. So that the output gear 51 on the output shaft 37 cannot slip to the left, a distance ring 52 is located on the output shaft 37 between the deep-groove ball bearing 39 and the output gear 51.

An axial force, directed to the right with respect to FIG. 3, of the output shaft 37 is transmitted by an annular shoulder formed on the bearing seat 48 via the inner bearing race of the deep-groove ball bearing 39, the distance sleeve 52 and the output gear 51 to the deep-groove ball bearing 38, which is supported against the annular shoulder 43. A force directed to the left, on the other hand, is introduced by the output shaft 37 via a retaining ring 53 on the right-hand outside of the inner bearing race of the deep-groove ball bearing 38 and is transmitted from there via the output gear 51, the distance bush 52 and the deep-groove ball bearing 39 to the retaining ring 46.

At its side adjacent to the gearbox end wall 24, the output shaft 37 merges into a neck part 54, which projects through an opening 55 in the frame-head means 15.

A cylindrical extension 56 is integrally formed on the neck part 54 on the other side of the frame-head means 15, and finally an annular end plate 57 adjoins this cylindrical extension 56.

The annular end plate 57 is a cylindrical thick disk having a cylindrical outer circumferential surface 58, which merges at the end face remote from the neck part 54 into a faced annular surface 59. A total of four tapped holes 61 are located in the end plate 57 and merge radially outward into fitting holes 62.

The rope drum 17 itself is an essentially cylindrical tube, in the outer circumferential surface of which rope grooves 63 are made. At its two front ends 64 and 65, the rope drum 17 is provided with recesses 66 and 67 forming locating seats. The recess 66 consists of a cylindrical bore 68, which starts from the front end 64 and is concentric to the axis of the rope drum 17. At its inner end, the cylindrical recess 68 is defined by an annular shoulder 69. The diameter of the cylindrical surface 68 is exactly equal to the outside diameter of the cylindrical surface 58 on the end plate 57.

Finally, in the region of the recess 66, the rope drum contains a plurality of radially running fitting holes 71, which correspond in diameter and number to the fitting holes 62 in the end plate 57.

In the fitted-together state, the annular surface 59 bears on the annular shoulder 69, and the fitting holes 71 are in alignment with the fitting holes 62. In this state, a corresponding number of fitting screws 72, the shank of which consists of a threaded section 73 and a fitting-part section 74, can be screwed into the tapped hole 61.

The rope drum 17 is designed in the same way at the other front end 65, for which reason the same reference numerals are used in this respect for the structural elements appearing there.

A further end plate 75, which in its circumferential contour is identical to the end plate 57, sits in the recess 67 at the front end 65. The difference merely consists in the fact that the end plate 57 merges into the output shaft 37, whereas the end plate 75 merges into a bearing journal 76. The structural elements at the end plate 75 which are necessary for the interaction with the rope drum 17 are therefore provided with the same reference numerals as at the end plate 57.

The bearing journal 76 is provided with a seating surface 77 for a deep-groove ball bearing 78 and a stop shoulder 79, against which the inner bearing race of the deep-groove ball bearing 78 bears. The deep-groove ball bearing 78 is axially secured on the bearing journal 76 by means of a retaining ring 81.

The deep-groove ball bearing 78 fits in a cylindrical bearing seating bore 82 of a bearing seating support 83, which is firmly screwed with its outwardly pointing flange 84 to the outside of the frame-head means 16. To this end, an appropriate number of screws 85 lead through corresponding holes in the bearing support 83 and the plate- or sheet-like frame-head means 16.

The deep-groove ball bearing 76 is axially secured in the bearing bore 82 by means of two internal retaining rings 86 and 87 at a corresponding distance from one another.

The rope hoist 9 described is assembled in such a way that first of all the ball bearing 34 is pressed into the associated bearing seat 36. The gear 39 is then inserted through an opening (not shown) in the side-wall arrangement 25 until its hub bore is in alignment with the locating bore in the ball bearing 34. The layshaft 32 interlocked with the pinion 31 may now be inserted through the still free bearing seating bore 35, in the course of which it slides through the gear 29 and is accommodated by the ball bearing 34. The rolling-contact bearing 33 is then pressed in, whereby the layshaft 32 is mounted at both ends, and in addition a rotationally locked connection with the gear 29 is produced via a multi-tooth interlocking system (not shown in any more detail).

The output shaft 37 is fitted next by first of all the ball bearing 38 being pressed into the associated bearing seat 42. The ball bearing 39 is slipped onto the output shaft 37 onto the seat 48 until it bears against the annular shoulder defining the bearing seat 48. The distance ring 52 is then put on. The output gear 51 is now inserted through an assembly opening contained in the side-wall arrangement 25, and the output shaft 37 is inserted into the gearbox 22 from the bearing bore 44, the output shaft 37 sliding through the hub bore, which has a corresponding interlocking system, of the output gear 51 until the bearing seat 47 fits in the deep-groove ball bearing 38. In this end position, the retaining ring 53 may be snapped onto the output shaft 37, and in addition the retaining ring 46 may be inserted to secure the ball bearing 39. The gearing 19 is thus essentially ready-assembled.

The motor 18 is flange-mounted on the gearing, ready-assembled to this extent, and is tightly screwed to corresponding extensions of the gearbox end wall 24 by means of screws (not shown). The pinion 28, sitting on the armature shaft 26 in a rotationally locked manner, meshes with the tooth system of the layshaft gear 29.

The construction unit preassembled in this way, consisting of the drive motor 18 and the gearing 19, can now be readily screwed to the frame-head means 15 by means of fastening screws 91, the end plate 57, which is in one piece with the output shaft 37, projecting into the space between the two frame-head means 15, 16.

The rope drum 17 is next provided with the end plate 75 by the latter being pushed into the recess 67 until it bears against the shoulder 69 and by being screwed tight by means of the fitting screws 72. The deep-groove ball bearing 78 may then be slipped onto the bearing journal 76 and secured by means of the retaining ring 81. This deep-groove ball bearing 78 has already been fitted beforehand in the bearing support 83 and axially secured there by means of the two retaining rings 86 and 87.

Once the rope drum 17 has been preassembled to this extent, its other front end 64 is slipped onto the flange plate 57, and the bearing support 83 is screwed to the frame-head means 16. Finally, the fitting screws 72 are screwed into the end plate 57, whereby assembly is complete.

In the rope hoist 9 described, it is apparent that the rope drum 17 is mounted by a separate drum bearing in the region of the frame-head means 16 and is mounted at the other end merely by the bearings of the output shaft 37. There is no separate bearing for mounting the rope drum 17 on the gearing side. In addition, a preassembled unit, consisting of gearing 19 and motor 18, can readily be produced, and this preassembled unit can easily be connected to the rope drum 17 for the final assembly.

In a rope hoist, the output shaft of the gearing is provided in one piece with an end plate. This end plate is designed in such a way that it can be inserted into a locating seat of the tubular rope drum. The end plate is screwed in the rope drum by means of radial fitting screws.

There is also a recess at the other end of the rope drum, and a similar end plate can be fastened in this recess in the same manner. This other end plate carries a bearing journal. On account of this arrangement, the manufacture of the rope drum and the entire assembly are simplified, complicated shaft joints between the output shaft and the rope drum being dispensed with on account of the mounting of the rope drum by means of the output shaft of the gearing. In addition, the rope hoist may be split up into comparatively small subassemblies for dispatch.

What is claimed is:

1. A rope hoist comprising:

a frame having a base and first and second headers extending transversely to said base in spaced relation to each other, an elongated tubular rope drum having opposed ends and being rotatably mounted between said frame headers, a gearbox mounted on one of said frame headers, said gearbox including a housing and a geared transmission, said gear transmission having a rotatable output shaft extending outwardly of said housing, said output shaft having an end portion in the form of a unitary flange plate disposed outwardly of said housing, one of said rope drum ends being formed with a flange seat into which said output shaft flange plate is positioned, said output shaft flange plate being secured to said rope drum by a plurality of radial bolts extending through radial holes in said rope drum at said flange seat, and a drive motor mounted on said gearbox housing for driving said output shaft.

2. A rope hoist according to claim 1 wherein the locating seat is a recess.

3. A rope hoist according to claim 2 wherein said recess defines a cylindrical surface coaxial to the rope drum and an annular shoulder.

4. A rope hoist according to claim 3 wherein said annular shoulder lies in the rope drum.

5. A rope hoist according to claim 1 including an output gear mounted on the output shaft.

6. A rope hoist according to claim 5 wherein said output shaft has a bearing seat for said end plate and said output gear.

7. A rope hoist according to claim 1 including an end plate at an end of said rope drum remote from said gear box, said end plate having a one-piece bearing journal.

8. A rope hoist according to claim 7, wherein the bearing journal has a bearing seat.

9. A rope hoist according to claim 1 wherein said gearbox has a side-wall and two end walls connected to said side-wall, and said end walls contain a plurality of bearing seats, in alignment with one another, for bearings of the output shaft.

10. A rope hoist according to claim 1 in which one of said frame headers is located between the rope drum and the gearbox.

11. A rope hoist according to claim 1 wherein said drive motor is arranged outside the rope drum and said drive motor has an armature shaft parallel to an axis of the rope drum.

12. A rope hoist according to claim 1 wherein the rope drum has a locating seat at each end, and an end plate positioned in each locating seat.

13. A rope hoist according to claim 1, wherein the frame is part of a crab carriage.

14. The rope hoist of claim 1 in which said flange is formed with threaded radial holes into which said bolts are threadedly engaged.

* * * * *